US007160079B2

(12) United States Patent
Iijima et al.

(10) Patent No.: US 7,160,079 B2
(45) Date of Patent: Jan. 9, 2007

(54) TURBINE FUEL PUMP

(75) Inventors: Masaaki Iijima, Gunma (JP); Junichi Motojima, Gunma (JP)

(73) Assignee: Hitachi, Ltd., Tokyo-to (JP)

( * ) Notice: Subject to any disclaimer, the term of this patent is extended or adjusted under 35 U.S.C. 154(b) by 0 days.

(21) Appl. No.: 11/377,314

(22) Filed: Mar. 17, 2006

(65) Prior Publication Data

US 2006/0159546 A1 Jul. 20, 2006

Related U.S. Application Data

(63) Continuation of application No. 10/784,790, filed on Feb. 24, 2004, now Pat. No. 7,048,494.

(30) Foreign Application Priority Data

Feb. 25, 2003 (JP) ..... 2003-047287

(51) Int. Cl.
*F04D 5/00* (2006.01)

(52) U.S. Cl. ..... 415/55.1; 418/228; 418/237; 418/238

(58) Field of Classification Search ..... 415/55.1–55.7; 416/228, 235, 237, 238
See application file for complete search history.

(56) References Cited

U.S. PATENT DOCUMENTS

| | | | |
|---|---|---|---|
| 2,042,499 | A | 6/1936 | Brady |
| 3,899,266 | A | 8/1975 | Masai et al. |
| 5,123,809 | A | 6/1992 | Ito et al. |
| 5,372,475 | A | 12/1994 | Kato et al. |
| 5,407,318 | A | 4/1995 | Ito et al. |
| 5,762,469 | A | 6/1998 | Yu |
| 2001/0036400 | A1 | 11/2001 | Kobayashi et al. |
| 2003/0228211 | A1 | 12/2003 | Motojima et al. |
| 2003/0231953 | A1 | 12/2003 | Ross |

FOREIGN PATENT DOCUMENTS

| | | | |
|---|---|---|---|
| EP | 0 563 957 | A1 | 10/1993 |
| JP | 6-229388 | A | 8/1994 |
| JP | 2002/339889 | A | 11/2002 |

*Primary Examiner*—Christopher Verdier
(74) *Attorney, Agent, or Firm*—Sughrue Mion, PLLC

(57) ABSTRACT

A turbine fuel pump including a cylindrical casing, an electric motor accommodated in the casing, a pump housing mounted into the casing, and an impeller disposed within the pump housing and driven around an axis in a rotational direction by the electric motor. The impeller includes a plurality of vanes each formed into a generally rectangular plate including a tip end face that extends circumferentially to define an outer peripheral surface of the impeller, and front and rear faces respectively located on forward and rearward sides in the rotational direction of the impeller. The front face is curved such that a tip end portion thereof is positioned forwardly in the rotational direction of the impeller relative to a root portion thereof. A chamfer portion is disposed between the tip end face and a tip end portion of the front face.

16 Claims, 6 Drawing Sheets

TURBINE FUEL PUMP

This is a continuation of application Ser. No. 10/784,790 filed Feb. 24, 2004 now U.S. Pat. No. 7,048,494. The entire disclosure of the prior application, application Ser. No. 10/784,790 is considered part of the disclosure of the accompanying application and is hereby incorporated by reference.

BACKGROUND OF THE INVENTION

The present invention relates to a fuel pump of a turbine type which is suitably adapted for feeding fuel, for example, to an engine of automobiles.

In general, vehicles such as automobiles are provided with a fuel pump for feeding fuel to an engine thereof. As the fuel pump, there are known fuel pumps of a turbine type in which a disk-shaped impeller is rotatively driven to feed the fuel under pressure.

Japanese Patent Application First Publication No. 6-229388 discloses a fuel pump including a cylindrical casing, an electric motor as a power source for the fuel pump and a rotating shaft coupled to an output side of the electric motor which are accommodated in the casing.

A pump housing is disposed at one end portion of the casing in which a tip end portion of the rotating shaft is located. A suction port, a discharge port and an annular fuel path connected to the suction and discharge ports are defined within the pump housing. An impeller is rotatably disposed within the pump housing and coupled to the tip end portion of the rotating shaft. The impeller is located on an inner circumferential side of the fuel path.

When the impeller is rotatively driven by the electric motor via the rotating shaft, the fuel pump sucks the fuel through the suction port by rotation of the impeller and then delivers under pressure the fuel through the fuel path toward the discharge port.

The impeller is formed into a toothed disk shape, for example, by injection-molding a resin material, and provided at an outer periphery thereof with a plurality of vanes circumferentially spaced from each other. The vanes are arranged within the fuel path when assembled in the fuel pump. The respective vanes project radially outwardly from an annular body of the impeller and are formed into a rectangular plate whose projecting end or tip end has, for example, a pointed shape or an acute-angled shape.

In the thus arranged fuel pump, merely a slight change in, for example, shape, dimension, etc., of the vanes of the impeller gives a considerable influence on efficiency of fuel delivery under pressure by the impeller, i.e., pump efficiency. For this reason, conventionally, in order to form the respective vanes into predetermined shape, dimensions, etc., the impeller must be molded from a resin material at high accuracy with a great care, and an outer peripheral surface of the impeller, namely, the tip end faces of the vanes, as well as opposite faces thereof must be subjected to further mechanical processing.

SUMMARY OF THE INVENTION

As described above, in the related art, the impeller with vanes has been molded from a resin material with high accuracy, and then further subjected to mechanical processing to achieve the desired pump efficiency. However, upon the molding and mechanical processing of the impeller as well as assembling thereof into a fuel pump, the impeller is exposed to various external forces. Such external forces are applied to the impeller, for example, upon removal of the molded impeller from a resin molding machine, upon grinding of the outer peripheral surface thereof, etc. If the external forces are exerted onto the tip ends of the respective vanes of the impeller which have a pointed or acute-angled shape, there will occur such a risk that the tip ends of the vanes are broken.

Thus, in the related art, the respective vanes of the impeller tend to suffer from complicated and irregular cracks and breakage during the process for production of the fuel pump. In addition, if the shape of the respective vanes is out of design specification due to the cracks and breakage, there will occur problems such as deterioration in pump efficiency. To avoid these problems, specific facilities and control measures are required for preventing the vanes of the impeller from undergoing the occurrence of such cracks and breakage during the production process, resulting in increased production costs.

The present invention has been made in view of the above problems in the related arts. An object of the present invention is to provide a turbine fuel pump that can be free from occurrence of cracks or breakage in vanes of an impeller thereof, produced by a simple process due to facilitated handling thereof, and enhanced in pump efficiency.

In one aspect of the present invention, there is provided a turbine fuel pump comprising:

a cylindrical casing;

an electric motor accommodated in the casing;

a pump housing mounted into the casing, the pump housing including a suction port, a discharge port and a fuel path connected to the suction and discharge ports; and an impeller disposed within the pump housing and driven around an axis in a rotational direction by the electric motor, the impeller including a generally annular body and a plurality of vanes projecting radially outwardly from the body and disposed within the fuel path, each of the vanes being formed into a generally rectangular plate including a tip end face that extends circumferentially to define an outer peripheral surface of the impeller, a front face located on a forward side in the rotational direction of the impeller and having a root portion located on a side of the body of the impeller and a tip end portion located on a side of an outer periphery of the impeller, the front face being curved such that the tip end portion is positioned forwardly in the rotational direction of the impeller relative to the root portion, a rear face located on a rearward side in the rotational direction of the impeller, and a chamfer portion disposed between the tip end face and the tip end portion of the front face.

DETAILED DESCRIPTION OF THE INVENTION

Figure 1:
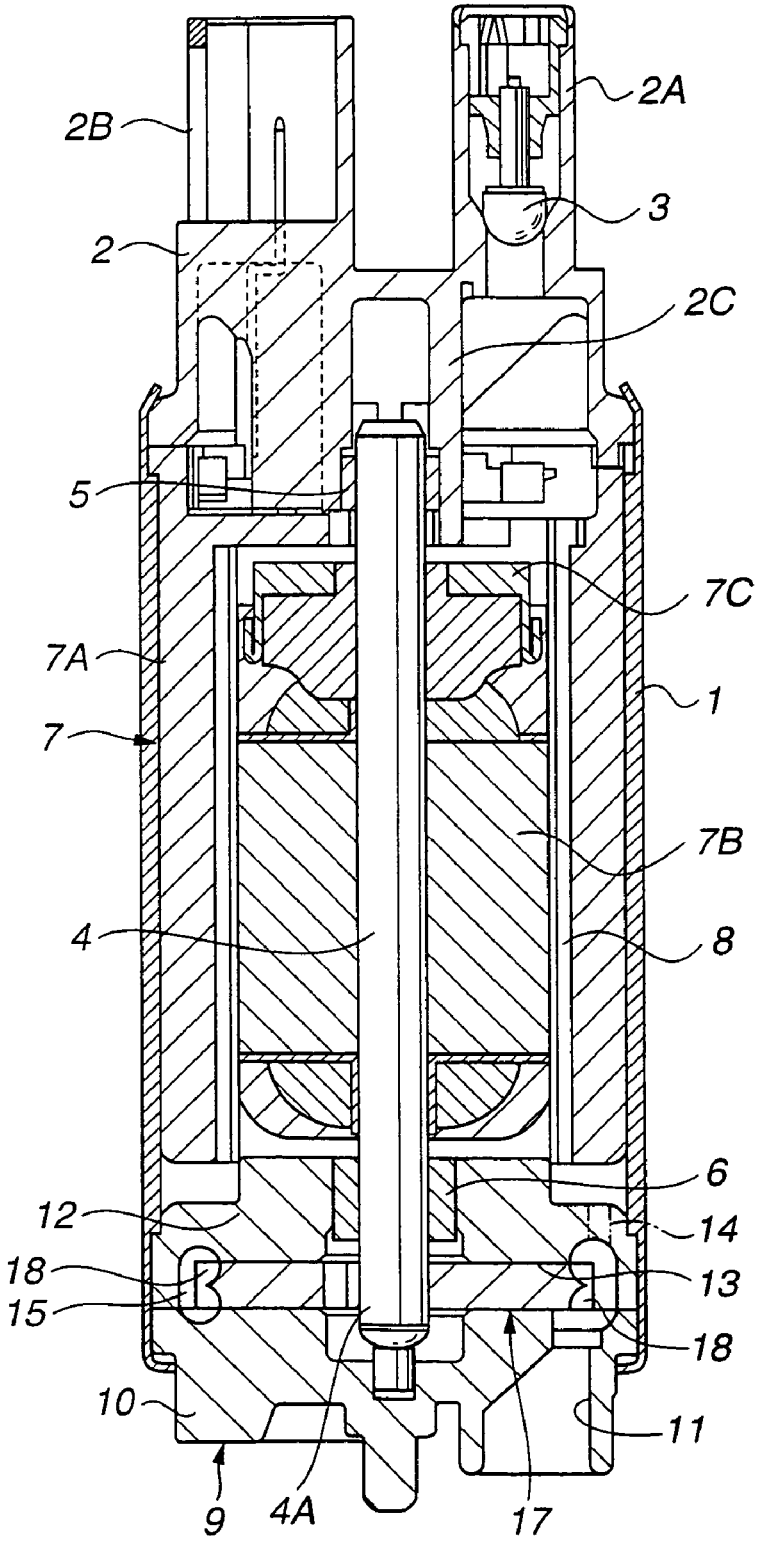
FIG. 1 is a longitudinal cross-sectional view of a turbine fuel pump according to the first embodiment of the present invention.

Referring to FIGS. 1 to 6, a turbine fuel pump according to a first embodiment of the present invention is explained in detail below. The fuel pump includes cylindrical casing 1 as an outer shell of the fuel pump. Opposite axial open ends of casing 1 are respectively closed by discharge cover 2 and pump housing 9 as described in detail later.

Discharge cover 2 is of a bottom-closed cylindrical shape, and includes discharge port 2A and connector portion 2B both projecting outwardly from discharge cover 2, as well as bearing sleeve 2C formed at a center thereof so as to extend toward an inside of casing 1.

Check valve 3 for retention of residual pressure is disposed within discharge port 2A. Check valve 3 is opened upon rotation of electric motor 7 as described later to discharge fuel flowing through casing 1 from discharge port 2A toward an external fuel conduit (not shown), etc. Check valve 3 is closed upon disenergization of electric motor 7 for preventing the fuel once discharged from casing 1 from returning back thereto to keep an inside of the fuel conduit under a given residual pressure.

Rotating shaft 4 is supported so as to be rotatable about axis O—O within casing 1. Rotating shaft 4 extends along axis O—O shown in FIG. 2 and has an axial middle portion onto which rotor 7B of electric motor 7 as described later is mounted. Rotating shaft 4 may be constituted from a cylindrical metal rod. Specifically, one axial end portion of rotating shaft 4 is rotatably supported by bearing sleeve 2C of discharge cover 2 through bushing 5. An opposite axial end portion of rotating shaft 4 is rotatably supported on an inner peripheral surface of lid 12A of inside housing 12 through busing 6.

Rotating shaft 4 includes engaging shaft portion 4A which is integrally formed with the opposite axial end portion and projects outwardly beyond busing 6 into pump housing 9. Impeller 17 is secured to engaging shaft portion 4A. Engaging shaft portion 4A has a non-circular cross-section so as to prevent a relative rotation between engaging shaft portion 4A and impeller 17.

Electric motor 7 is accommodated within casing 1 and engaged therewith at a position between discharge cover 2 and pump housing 9. Electric motor 7 includes cylindrical yoke 7A supporting a stator (not shown) made of a permanent magnet, rotor 7B and commutator 7C which are inserted into yoke 7A with a clearance and fitted onto rotational shaft 4 for a unitary rotation therewith, and a conductive brush (not shown) that comes into slide contact with commutator 7C.

When electric motor 7 is energized by electric current supplied from connector portion 2B of discharge cover 2 to rotor 7B through commutator 7C, rotor 7B is unitarily rotated together with rotating shaft 4 to thereby rotatively drive impeller 17. Yoke 7A cooperates with rotor 7B to define fuel passage 8 therebetween through which the fuel discharged from discharge port 14 of pump housing 9 is allowed to flow toward discharge cover 2.

Pump housing 9 is fitted to one axial end portion of casing 1 in which engaging shaft portion 4A of rotational shaft 4 is located. Pump housing 9 accommodates impeller 17 having a generally disk shape. Pump housing 9 includes outer housing portion 10 and inner housing portion 12 that mate with each other in an axial direction of casing 1.

Figure 2:
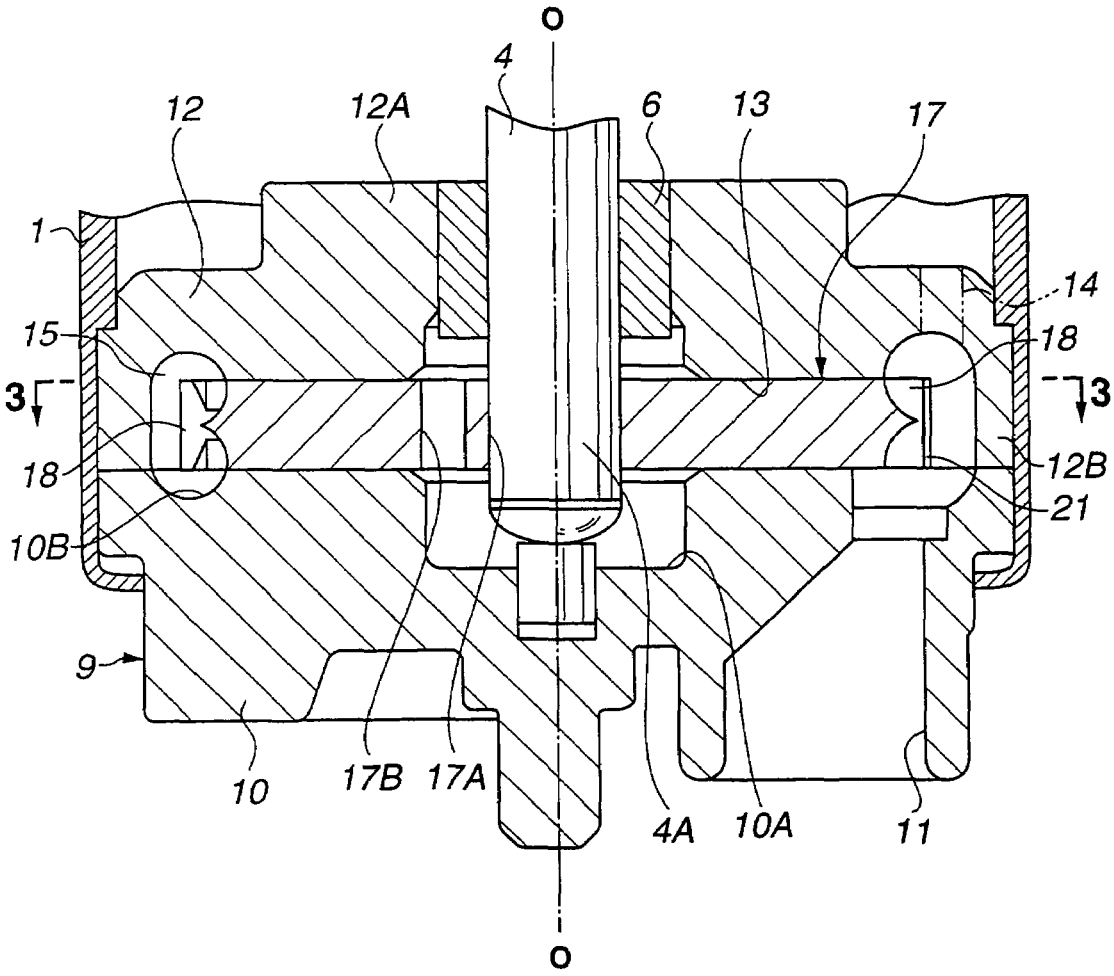
FIG. 2 is an enlarged view of a part of FIG. 1 including a pump housing, an impeller, etc.

Referring to FIG. 2, outer housing 10 and inner housing 12 are explained in more detail. Outer housing 10 serves for closing casing 1 from outside, and is engaged to casing 1 by a suitable method, for instance, caulking. Outer housing 10 is integrally formed with suction inlet 11 through which fuel is introduced into the fuel pump. Outer housing 10 further includes circular recess 10A located on a central side of impeller 17, and arcuate groove 10B located on an outer circumferential side of impeller 17. Circular recess 10A receives a tip end of engaging shaft portion 4A of rotational shaft 4. Arcuate groove 10B extends in a circumferential direction of a circle drawn around axis O—O and has a generally semi-circular section.

Inner housing 12 is engaged in casing 1, and formed into a flat cylindrical body with a lid as shown in FIG. 2. Inner housing 12 includes cylindrical portion 12B mating with outer housing 10, and annular lid portion 12A closing one axial end of cylindrical portion 12B against casing 1. Cylindrical portion 12B has circular turbine recess 13 for accommodating impeller 17, on an inside surface thereof opposing to the mating surface of outer housing 10. Lid portion 12A has, on an inner peripheral side thereof, outlet port 14 extending therethrough in the axial direction of casing 1.

Outer housing 10 and inner housing 12 cooperate with each other to define annular fuel path 15 formed along an outer periphery of turbine recess 13. Annular fuel path 15 includes arcuate groove 10B of outer housing 10. Annular fuel path 15 is in the form of a passage extending in a circumferential direction around axis O—O (axis center O) and having a generally elongated C-shape in section, as shown in FIG. 2.

Annular fuel path 15 is communicated at a leading end thereof with suction port 11 and at a terminal end thereof with outlet port 14. Inner housing 12 is formed with arcuate seal partition wall 16 projecting radially inwardly from an inner periphery of cylindrical portion 12B up to a radially inward position close to an outer periphery of impeller 17. Seal partition wall 16 establishes a seal against the outer periphery of impeller 17 between suction port 11 and outlet port 14 except for the portion corresponding to fuel path 15.

Figure 3:
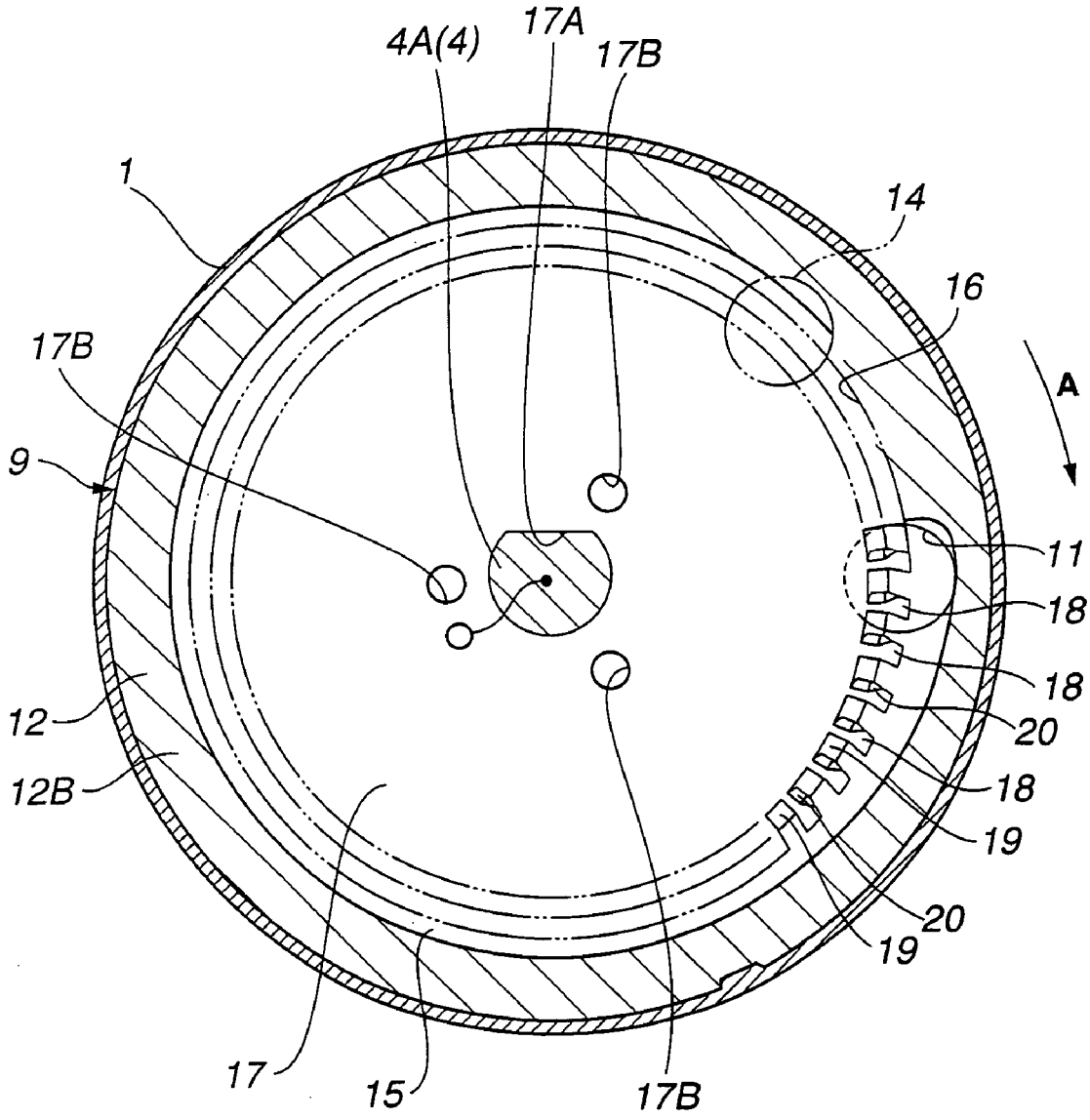
FIG. 3 is a cross-sectional view of the turbine fuel pump taken along line 3—3 of FIG. 2 which shows an inner housing as well as the impeller.

Generally disk-shaped impeller 17 as seen from FIGS. 2 and 3 is made of, for example, a reinforced plastic material, and rotatably accommodated within turbine recess 13 of pump housing 9. Impeller 17 is sealed between outer housing 10 and lid portion 12A of inner housing 12 in a floating fashion.

Impeller 17 is driven by electric motor 7 via rotating shaft 4 so as to rotate around axis O—O (axis center O) in a direction indicated by arrow A in FIG. 3. The rotation of impeller 17 allows the fuel to be sucked from suction port 11 into fuel path 15 and delivered under pressure through fuel path 15 to outlet port 14.

As illustrated in FIG. 3, impeller 17 has engaging hole 17A which is engaged with engaging shaft portion 4A of rotating shaft 4 so as to prevent a relative rotation between rotating shaft 4 and impeller 17 and allow a unitary rotation thereof. Impeller 17 has a plurality of though holes 17B around engaging hole 17A in order to equalize fuel pressures on axially opposite sides of impeller 17. In this embodiment, three though holes 17B are provided. Further, impeller 17 includes an annular body and a plurality of vanes 18 arranged along an outer periphery of the annular body. Vanes 18 project radially outwardly from the body of impeller 17 and are arranged in an equidistantly spaced relation to each other in a circumferential direction thereof.

Figure 4:
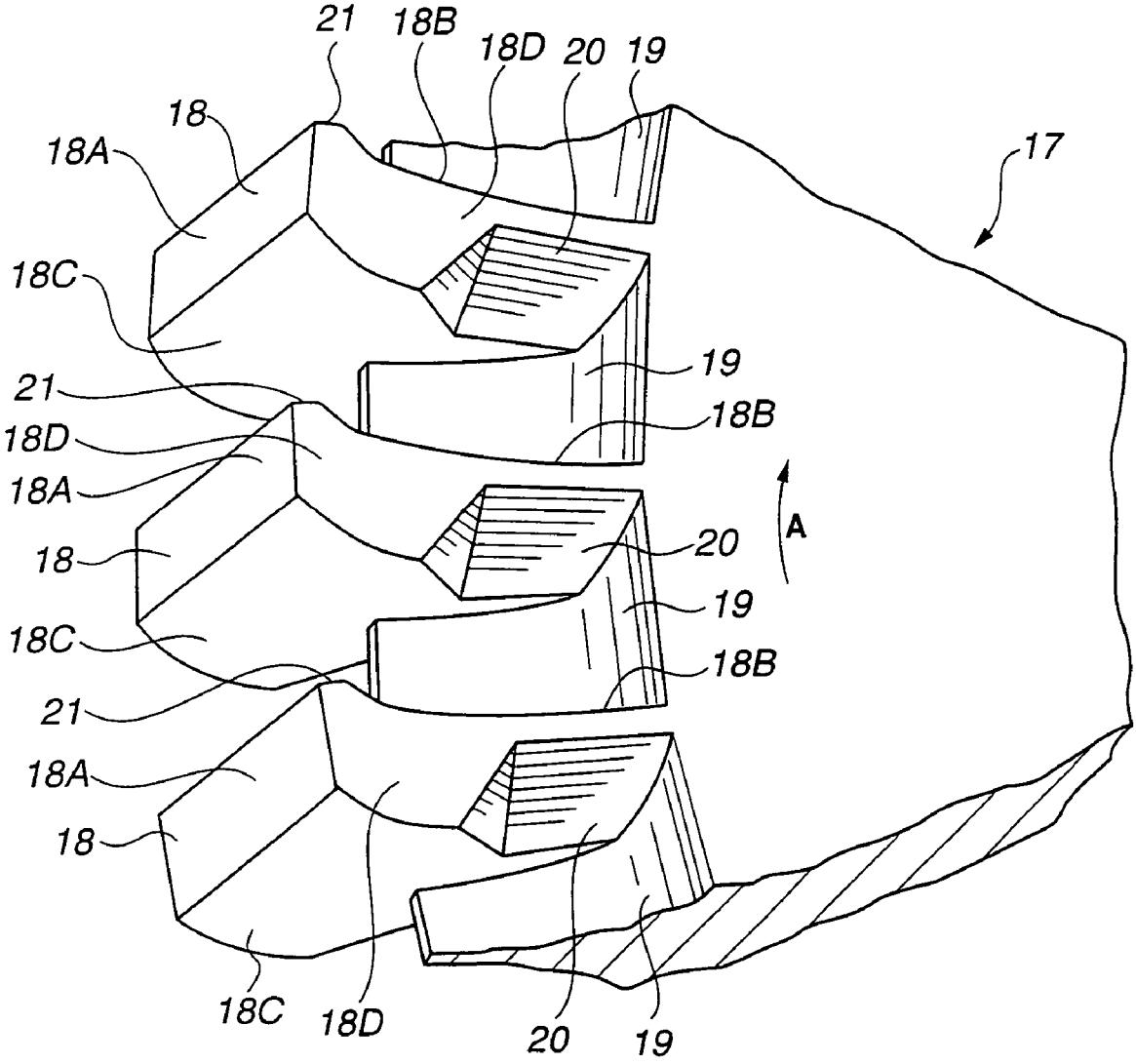
FIG. 4 is an enlarged perspective view showing essential parts of vanes of the impeller.

As illustrated in FIG. 4, each of vanes 18 is in the form of a plate having a generally rectangular shape in section. Each of vanes 18 has a projecting end portion, namely, a tip end portion, arcuately bent forwardly in the rotational direction of impeller 17, namely, forwardly in direction A shown in FIG. 4.

Figure 5:
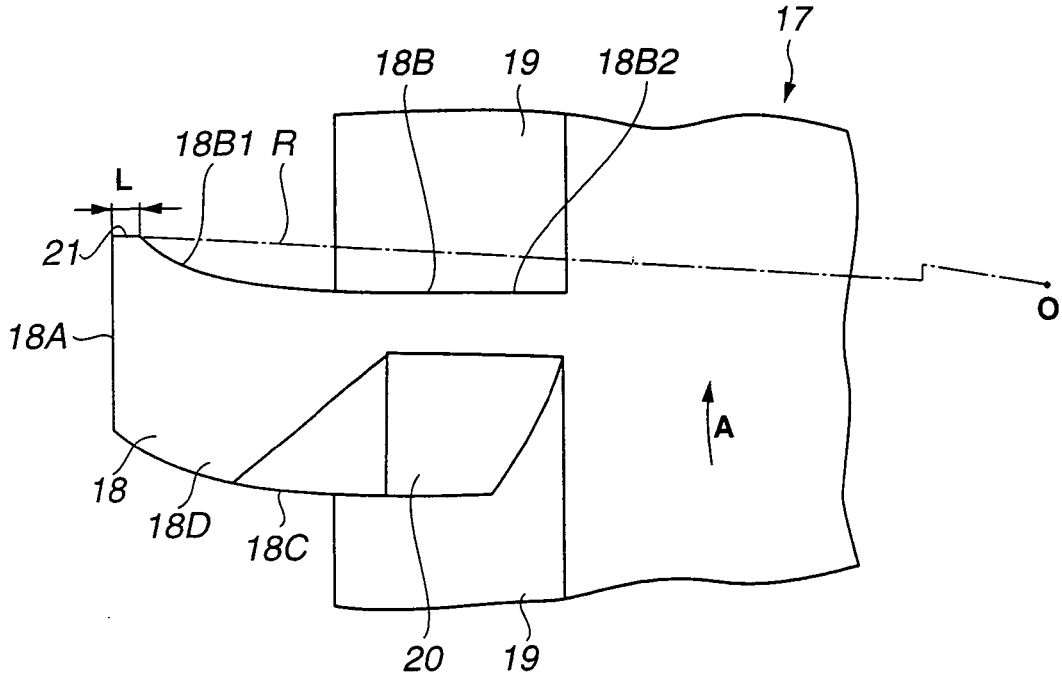
FIG. 5 is an enlarged plan view showing essential parts of the vane of the impeller.

Vane 18 includes rectangular tip end face 18A extending circumferentially to define an outer peripheral surface of impeller 17, front face 18B located on a forward side relative to tip end face 18A in the rotational direction of impeller 17, rear face 18C located on a rearward side relative to tip end face 18A in the rotational direction of impeller 17, and a pair of side faces 18D located on axially opposite sides of impeller 17. Specifically, as illustrated in FIG. 5, front face 18B of vane 18 includes tip end portion 18B1 located on a side of the outer periphery of impeller 17, and root portion 18B2 located on a side of the body of impeller 17. Front face 18B is curved such that tip end portion 18B1 is forwardly positioned or advanced in the rotational direction of impeller 17 relative to root portion 18B2. Thus, vane 18 is formed into a so-called forward advanced vane.

Formed between adjacent vanes 18 are a pair of arcuate recesses 19 which are arranged in back-to-back relation to each other in the axial direction of impeller 17. Only one of the pair of arcuate recesses 19 is shown in FIGS. 4 and 5. Each of arcuate recesses 19 has a mountain-like shape whose apex is located at the mid of axial length of impeller 17. Arcuate recess 19 has a radius of curvature which is substantially identical to that of an arcuate periphery of fuel path 15, namely, that of an arcuate wall surface of outer and inner housings 10 and 12 of pump housing 9 which defines the arcuate portion of fuel path 15 as shown in FIG. 2.

Vane 18 further has, on a root side thereof, a pair of slant surfaces 20 formed on the axially opposite sides of impeller 17. Only one of the pair of slant surfaces 20 is shown in FIGS. 4 and 5. Each of slant surfaces 20 is formed by cutting a corner between rear face 18C and each of side faces 18D at an inclined angle relative thereto in order to allow the fuel to smoothly enter a space between adjacent vanes 18.

As seen from FIGS. 4 and 5, vane 18 has chamfer portion 21 disposed between tip end face 18A and tip end portion 18B1 of front face 18B. Chamfer portion 21 is constituted by a flat surface formed by cutting a corner between tip end face 18A and tip end portion 18B1 of front face 18B. Chamfer portion 21 extends on a plane defined by line R extending radially outwardly from a center of rotation of impeller 17, namely, axis center O, and axis O—O of impeller 17. Namely, chamfer portion 21 is aligned with a plane containing axis O—O of impeller 17.

As illustrated in FIG. 5, chamfer portion 21 has length L as measured in section perpendicular to axis O—O. Length L of chamfer portion 21 uniformly extends between tip end face 18A and tip end portion 18B1 of front face 18B. Length L of chamfer portion 21 is defined according to the following formula based on experimental data shown in FIG. 6 as explained later:

$$0.05 \leqq L \leqq 0.15 \text{ (unit: mm)}$$

With the provision of chamfer portion 21 having length L within the range, the tip end of vane 18 can be formed into a break-free or hardly-broken shape, and a good pump efficiency can be maintained.

Figure 6:
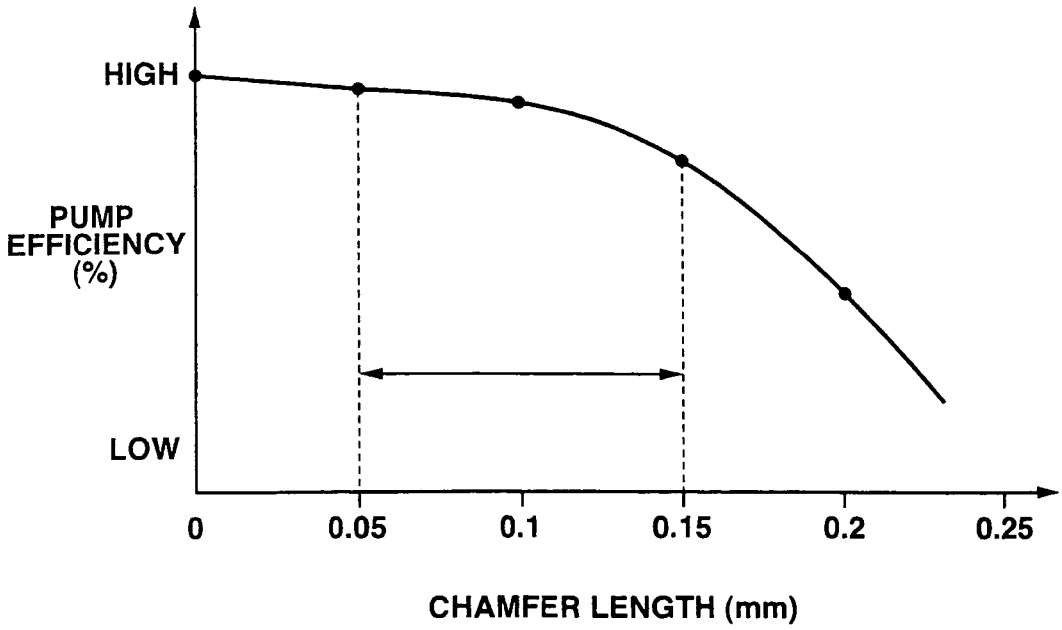
FIG. 6 is a characteristic curve showing a relationship between a length of a chamfer portion of the impeller and a pump efficiency.

Referring to FIG. 6, the relation between length L of chamfer portion 21 and the pump efficiency which has become apparent from the experimental data, is described below.

When length L of chamfer portion 21 is in the range of 0.05 mm to 0.15 mm, the tip end of vane 18 of impeller 17 has a fully stable shape capable of withstanding an external force applied thereto. More specifically, a portion between tip end face 18A and front face 18B of vane 18 is formed into a non-acute-angled shape, i.e., a break-free or hardly-broken shape. Further, the formation of chamfer portion 21 gives substantially no adverse influence on the fuel flow within fuel path 15. Therefore, the pump efficiency is kept in a degree substantially identical to or slightly lower than that in the case where no chamfer portion 21 is provided.

When length L of chamfer portion 21 exceeds 0.15 mm, it has been found that the fuel flow within fuel path 15 is adversely affected by chamfer portion 21, resulting in considerable deterioration in pump efficiency.

As a result, by adjusting length L of chamfer portion 21 within the range defined according to the above formula, impeller 17 is promoted in handing property thereof, and the fuel pump is operated at high efficiency.

The thus arranged turbine fuel pump according to the first embodiment of the present invention is operated as follows. When electric motor 7 is energized by supplying electric power thereto via connector 2B of discharge cover 2, rotor 7B is rotated together with rotating shaft 4, so that impeller 17 is rotatively driven within pump housing 9. The rotation of impeller 17 causes the fuel stored in a fuel tank (not shown) to be sucked into fuel path 15 through suction port 11 and then delivered under pressure through fuel path 15 by vanes 18 and finally discharged into casing 1 through discharge port 14.

According to the first embodiment of the present invention, since each of vanes 18 of impeller 17 has chamfer portion 21, the tip end of vane 18 is free from cracking or breaking even when impeller 17 is exposed to various external forces during the process for production of the fuel pump. This results in promoted handing property thereof as well as simplified production process. Further, even upon operation of the fuel pump, each of vanes 18 can show an enhanced strength at the tip end thereof, thereby improving durability of impeller 17 that is subjected to high speed rotation.

In particular, each of vanes 18 has front face 18B whose tip end portion 18B1 is forwardly positioned relative to root portion 18B2 thereof in the rotational direction of impeller 17, so that the acute-angled corner that tends to be cracked or broken will be formed between tip end portion 18B1 of front face 18B and tip end face 18A of vane 18. To avoid the occurrence of cracks and breakage, according to the present invention, chamfer portion 21 is provided at the corner between tip end portion 18B1 of front face 18B and tip end face 18A. Vane 18 is thus formed into a break-free or hardly-broken shape.

In this case, when length L of chamfer portion 21 is adjusted to the range of 0.05 mm to 0.15 mm as measured in section perpendicular to axis O—O, the tip end of vane 18 can be formed into a fully stable shape capable of withstanding impact due to external force applied thereto, etc. In addition, the provision of chamfer portion 21 gives no significant influence on pump efficiency, and can therefore maintain a sufficiently high pump efficiency substantially identical to that in the case where no chamfer portion 21 is provided.

Further, since chamfer portion 21 is formed into the flat surface along line R extending radially outwardly from the rotational center of impeller 17, namely, axis center O, a shape of a mold used for production of impeller 17 is more simplified as compared to that used in the case where a surface of the chamfer portion is inclined relative to line R.

Figure 7:
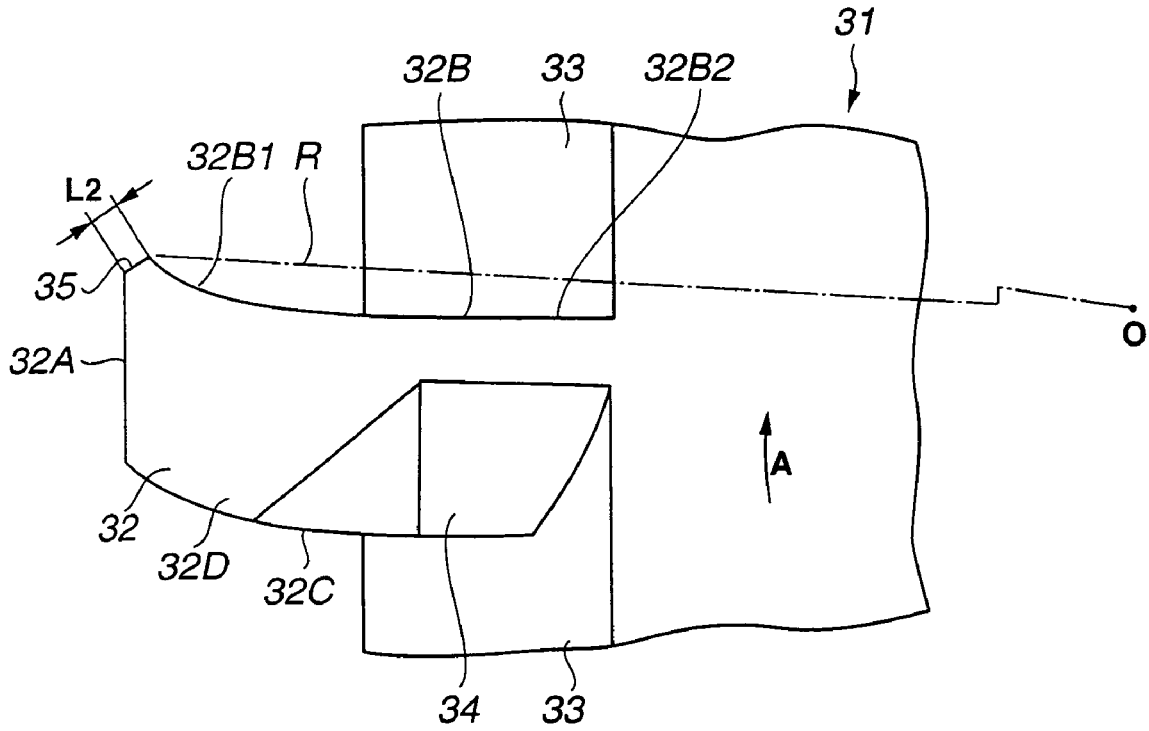
FIG. 7 is a view similar to FIG. 5, but showing an impeller of a turbine fuel pump according to the second embodiment of the present invention.

Referring to FIG. 7, a turbine fuel pump according to a second embodiment of the present invention is explained hereinafter. The turbine fuel pump of the second embodiment is different from that of the first embodiment in that a chamfer portion is formed at an inclined angle relative to a plane containing a rotational axis of impeller. Therefore, like parts are represented by like numerals used in the first embodiments, and detailed explanations thereof are omitted.

In the turbine fuel pump of the second embodiment, impeller 31 includes an annular body and a plurality of vanes 32 circumferentially arranged along an outer periphery of the body. Each of vanes 32 is formed into a plate having a generally rectangular shape in section, and include tip end face 32A, front face 32B, rear face 32C and a pair of side faces 32D similarly to the first embodiment. Front face 32B includes tip end portion 32B1 and root portion 32B2. Formed between adjacent vanes 32 are a pair of arcuate recesses 33 arranged in back-to-back relation to each other in the axial direction of impeller 31. Further, vane 32 has, on a root side thereof, a pair of slant surfaces 34 on axially opposite sides of impeller 31.

Each of vanes 32 includes chamfer portion 35 disposed between tip end face 32A and tip end portion 32B1 of front face 32B. Chamfer portion 35 is formed into a flat surface by cutting a corner between tip end face 32A and tip end portion 32B1 of front face 32B in substantially the same manner as in the first embodiment. Chamfer portion 35 has uniform length L2 extending between tip end face 32A and tip end portion 32B1 of front face 32B and measured in section perpendicular to axis O—O. Length L2 may be in the range of 0.05 mm to 0.15 mm.

Chamfer portion 35 is inclined at a predetermined angle relative to line R extending radially outwardly from the rotational center, namely, axis center O, of impeller 31. Chamfer portion 35 extends in a different direction from that of line R. In other words, chamfer portion 35 is inclined at the predetermined angle relative to a plane containing axis O—O of impeller 31.

The thus arranged turbine fuel pump according to the second embodiment can provide substantially the same effects and functions as those of the first embodiment. Further, when length L2 of chamfer portion 35 formed in impeller 31 is controlled to a predetermined dimension, the pump efficiency can be more effectively prevented from being adversely affected by chamfer portion 35.

This application is based on a prior Japanese Patent Application No. 2003-047287 filed on Feb. 25, 2003. The entire contents of the Japanese Patent Application No. 2003-047287 is hereby incorporated by reference.

Although the invention has been described above by reference to certain embodiments of the invention, the invention is not limited to the embodiments described above. Modifications and variations of the embodiments described above will occur to those skilled in the art in light of the above teachings. The scope of the invention is defined with reference to the following claims.

What is claimed is:

1. A turbine fuel pump comprising:

a cylindrical casing;

an electric motor accommodated in the casing;

a pump housing mounted into the casing, the pump housing including a suction port, a discharge port and a fuel path connected to the suction and discharge ports; and an impeller disposed within the pump housing and driven around an axis in a rotational direction by the electric motor, the impeller including a generally annular body and a plurality of vanes projecting radially outwardly from the body and disposed within the fuel path, each of the vanes being formed into a generally rectangular plate, the vanes each including a tip end face that extends circumferentially to define an outer peripheral surface of the impeller, a front face curved toward a forward side in the rotational direction of the impeller, the front face having a root portion located on a side of the body of the impeller and a tip end portion that is located on a side of an outer periphery of the impeller and positioned forwardly in the rotational direction of the impeller relative to the root portion, a rear face located on a rearward side in the rotational direction of the impeller, and a chamfer portion disposed between the tip end face and the tip end portion of the front face, wherein the chamfer portion is positioned forwardly in the rotational direction of the impeller relative to the root portion of the front face and has a uniform length between the tip end face and the tip end portion of the front face as measured in section perpendicular to the axis, and the uniform length of the chamfer portion is in a range of 0.05 mm to 0.15 mm.

2. The turbine fuel pump according to claim 1, wherein the chamfer portion is formed as a cut corner between the tip end face and the tip end portion of the front face.

3. The turbine fuel pump according to claim 1, wherein the chamfer portion is inclined relative to a plane containing the axis.

4. The turbine fuel pump according to claim 1, wherein the uniform length of the chamfer portion is in a range of 0.05 mm to 0.12 mm.

5. The turbine fuel pump according to claim 1, wherein the uniform length of the chamfer portion is in a range of 0.05 mm to 0.1 mm.

6. The turbine fuel pump according to claim 1, wherein each of the vanes includes side faces located on axially opposite sides of the impeller, and a pair of slant surfaces, each located on a respective side of the body of the impeller and formed as a cut corner between the rear face and each of the side faces.

7. A turbine fuel pump comprising:

a cylindrical casing;

an electric motor accommodated in the casing;

a pump housing mounted into the casing, the pump housing including a suction port, a discharge port and a fuel path connected to the suction and discharge, ports; and an impeller disposed within the pump housing and driven around an axis in a rotational direction by the electric motor, the impeller including a generally annular body and a plurality of vanes projecting radially outwardly from the body and disposed within the fuel path, each of the vanes being formed into a generally rectangular plate, the vanes each including a tip end face that extends circumferentially to define an outer peripheral surface of the impeller, a front face curved toward a forward side in the rotational direction of the impeller, the front face having a root portion located on a side of the body of the impeller and a tip end portion that is located on a side of an outer periphery of the impeller and positioned forwardly in the rotational direction of the impeller relative to the root portion, a rear face located on a rearward side in the rotational direction of the impeller, and a chamfer portion disposed between the tip end face and the tip end portion of the front face, wherein the chamfer portion is positioned forwardly in the rotational direction of the impeller relative to the root portion of the front face and comprises a surface inclined relative to a plane that contains the axis of the impeller.

8. The turbine fuel pump according to claim 7, wherein the surface of the chamfer portion is oriented, forwardly in the rotational direction of the impeller and inclined rearwardly relative to the plane that contains the axis of the impeller.

9. The turbine fuel pump according to claim 7, wherein the chamfer portion is formed as a cut corner between the tip end face and the tip end portion of the front face.

10. The turbine fuel pump according to claim 7, wherein the chamfer portion has a uniform length between the tip end face and the tip end portion of the front face as measured in section perpendicular to the axis.

11. The turbine fuel pump according to claim 7, wherein a uniform length of the chamfer portion is in a range of 0.05 mm to 0.15 mm.

12. The turbine fuel pump according to claim 7, wherein each of the vanes includes side faces located on axially opposite sides of the impeller, and a pair of slant surfaces, each located on a respective side of the body of the impeller and formed as a cut corner between the rear face and each of the side faces.

13. A turbine fuel pump comprising:

a cylindrical casing;

an electric motor accommodated in the casing;

a pump housing mounted into the casing, the pump housing including a suction port, a discharge port and a fuel-path connected to the suction, and discharge ports; and an impeller disposed within the pump housing and driven around an axis in a rotational direction by the electric motor, the impeller including a generally annular body and a plurality of vanes projecting radially outwardly from the body and disposed within the fuel path, each of the vanes being formed into a generally rectangular plate, the vanes each including a tip end face that extends circumferentially to define an outer peripheral surface of the impeller, a front face curved toward a forward side in the rotational direction of the impeller, the front face having a root portion located on a side of the body of the impeller and a tip end portion that is located on a side of an outer periphery of the impeller and positioned forwardly in the rotational direction of the impeller relative to the root portion, and a chamfer portion disposed between the tip end face and the tip end portion of the front face, wherein the chamfer portion is positioned forwardly in the rotational direction of the impeller relative to the root portion of the front face and is configured to be free from cracking or breaking during production of the fuel pump and maintains pump efficiency without substantially influencing a fuel flow within the fuel path during an operation of the fuel pump.

14. The turbine fuel pump according to claim 13, wherein the chamfer portion is formed as a cut corner between the tip end face and the tip end portion of the front face.

15. The turbine fuel pump according to claim 13, wherein the chamfer portion has a uniform length between the tip end face and the tip end portion of the front face as measured in section perpendicular to the axis.

16. The turbine fuel pump according to claim 13, wherein a uniform length of the chamfer portion is in a range of 0.05 mm to 0.15 mm.

* * * * *